United States Patent [19]

Fischer et al.

[11] Patent Number: 4,534,328

[45] Date of Patent: Aug. 13, 1985

[54] EMERGENCY CONTROL APPARATUS FOR A DIESEL ENGINE

[75] Inventors: Werner Fischer, Ditzingen; Ulrich Flaig, Markgröningen; Johannes Locher, Stuttgart, all of Fed. Rep. of Germany

[73] Assignee: Robert Bosch GmbH, Stuttgart, Fed. Rep. of Germany

[21] Appl. No.: 403,903

[22] Filed: Jul. 30, 1982

[30] Foreign Application Priority Data

Jul. 30, 1981 [DE] Fed. Rep. of Germany ..... 3130094

[51] Int. Cl.[3] ..... F02M 59/20; F02D 31/00

[52] U.S. Cl. ..... 123/359; 123/479; 123/198 D

[58] Field of Search ..... 123/198 D, 479, 357, 123/358, 359, 480

[56] References Cited

U.S. PATENT DOCUMENTS

| | | | |
|---|---|---|---|
| 3,834,361 | 9/1974 | Keely | 123/479 |
| 4,279,229 | 7/1981 | Arnold | 123/359 |
| 4,291,532 | 9/1981 | Robinson | 123/198 D |
| 4,334,406 | 6/1982 | Todd | 123/198 D |
| 4,383,511 | 5/1983 | Jones | 123/359 |
| 4,402,290 | 9/1983 | Höfer | 123/359 |
| 4,428,341 | 1/1984 | Hassler | 123/359 |
| 4,429,670 | 2/1984 | Vlanet | 123/198 D |
| 4,467,762 | 8/1984 | Fischer | 123/198 D |
| 4,487,180 | 12/1984 | Ito | 123/198 DB |

*Primary Examiner*—Carl Stuart Miller

*Attorney, Agent, or Firm*—Edwin E. Greigg

[57] ABSTRACT

An emergency control apparatus is proposed for a fuel metering system in a Diesel engine, where the signal processing unit (microcomputer) and/or a regulator can be bypassed. In the case of the failure of the signal processing unit, the position signal of the driving pedal is switched more or less directly to the regulator for triggering the control unit for the quantity-determining member, and if there is a failure of the regulator, a purely proportional regulator comes into action. It is thus assured that even in the case of failure emergency operation is guaranteed, the course of which emergency operation can essentially be influenced only by the driver of the vehicle.

8 Claims, 2 Drawing Figures

EMERGENCY CONTROL APPARATUS FOR A DIESEL ENGINE

BACKGROUND OF THE INVENTION

The present invention relates to the regulation of diesel injection systems, and in particular to an electrically or electronically controlled diesel injection systems having an emergency control apparatus.

In electrically or electronically controlled or regulated Diesel injection systems, safety devices are already known which protect the engine against an overload in case of failure. An example of such a safety system is described in German Offenlegungsschrift (laid-open application) No. 19 62 570. In the safety systems described a restoring device for a quantity-determining member is disclosed. This restoring device is activated whenever a regulatory circuit itself or a line leading from one of the individual sensors has been interrupted, with the result that the setting of the quantity-determining member then corresponds to that intended for small injection quantities.

In practical operation, it has now been demonstrated that this protective adjustment in the direction of a smaller quantity is not always satisfactory, for instance, if the Diesel engine drives a tractor and a failure occurs just when the tractor has been driven in difficult terrain. In the case of the known apparatus, the vehicle would then come to a stop at a time when high power was needed, which under some circumstances could have very expensive consequences in terms of time and money.

OBJECT AND SUMMARY OF THE INVENTION

It is an object of the present invention to provide a safety device for the fuel metering system of diesel engines.

According to the present invention a so-called emergency circuit is provided which is either manually or automatically engaged. This emergency circuit is connected to and is responsive to the condition of either/or the condition of a signal processing unit and regulator of the fuel metering system.

With the controlled apparatus according to the present invention for the fuel metering system of an internal combustion engine, it is assured that even under difficult conditions emergency operation is guaranteed. In this case, the sphere of influence of the driver is enlarged by providing direct control of the quantity of fuel to be injected. Despite everything, a thermal overload of the engine is not likely to be a problem, because emergency operation as a rule occurs under conditions of high load, in which an overload of the engine is not likely.

The invention will be understood and further objects and advantages thereof will become more apparent from the ensuing detailed description of the preferred embodiment, taken into conjunction with the drawing.

DESCRIPTION OF THE PREFERRED EMBODIMENT

Figure 1:
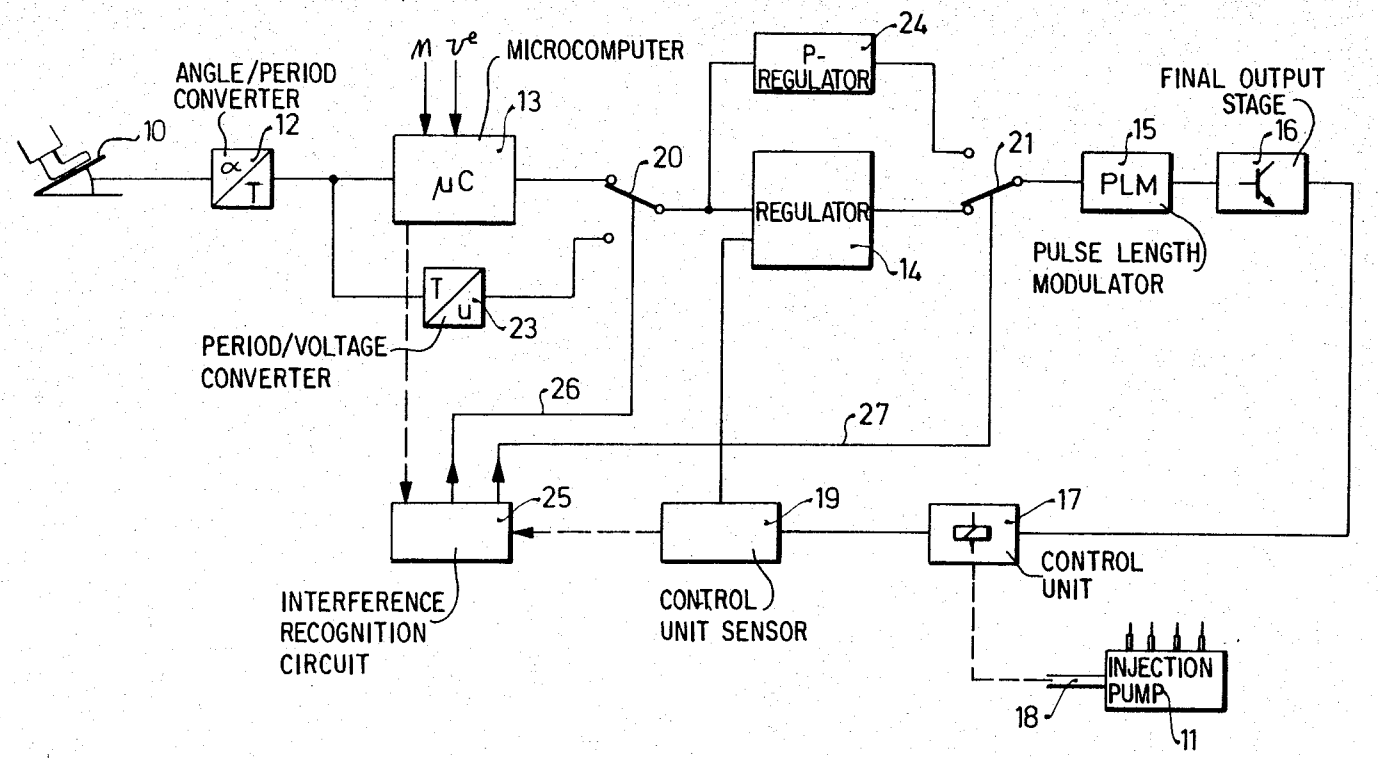
FIG. 1 is a block diagram of an exemplary embodiment of the invention.
Figure 2:
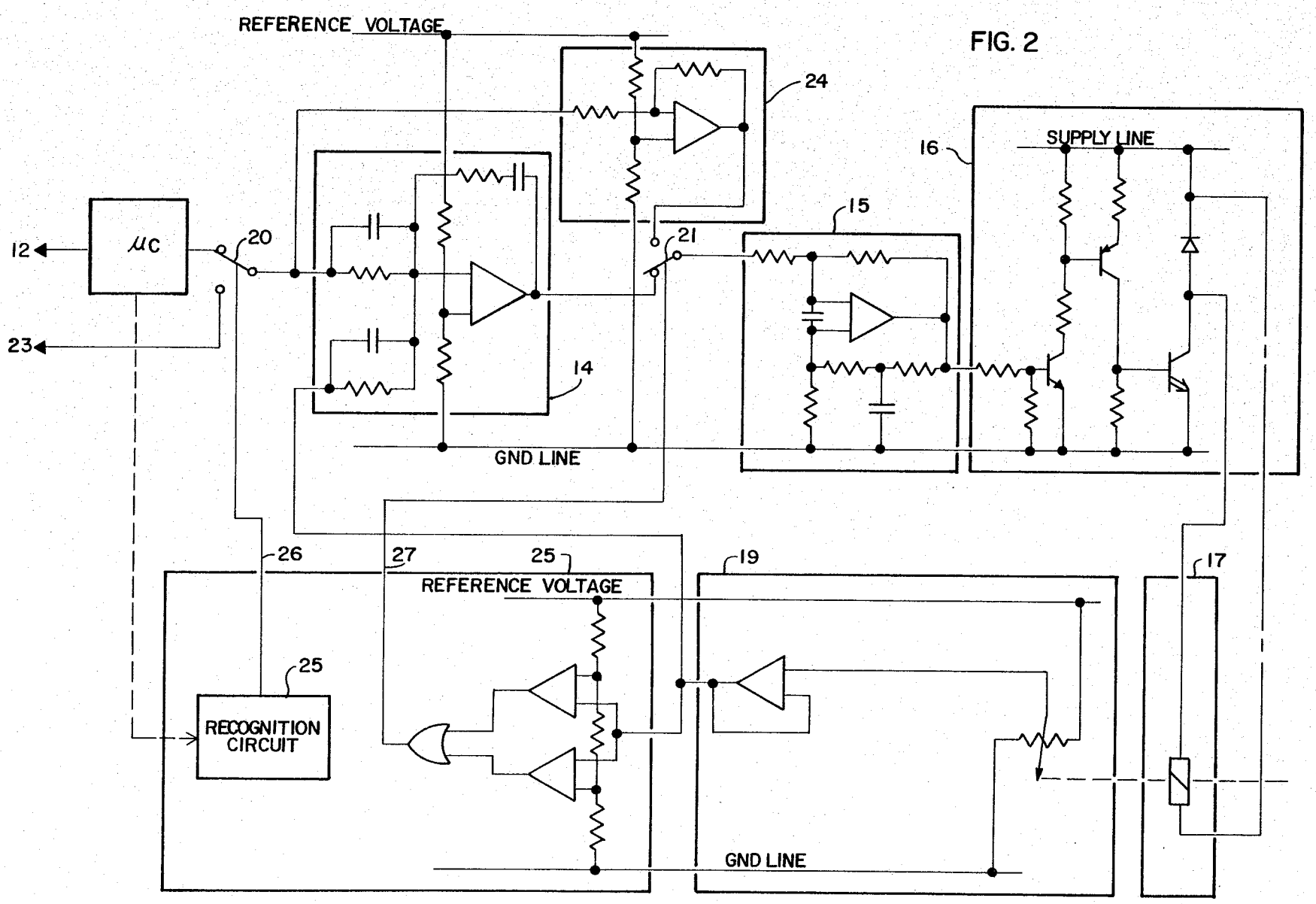
FIG. 2 is a more detailed circuit diagram of the block diagram of FIG. 1.

The exemplary embodiment relates to an emergency control system for a Diesel engine. A driving pedal is indicated by reference numeral 10 and the fuel pump for a diesel engine, not shown, is indicated by reference numeral 11. During normal operation, there is a series circuit from the driving pedal 10 to the pump 11 comprising the following components: driving pedal, angle/period converter 12, microcomputer 13, regulator 14, pulse length modulator 15, final output stage 16, control unit 17 and finally the quantity-determining member 18 connected with the injection pump 11. The position of the quantity-determining member 18 is detected by a control unit sensor 19, which delivers its output signal in turn back to the regulator 14. It is of importance that both the microcomputer 13 and the regulator 14 are each followed by a selective switch 20 and 21. It is thus possible in case of the failure of the microcomputer or the regulator or both to establish a separate signal line. A period/voltage converter 23 is located parallel to the microcomputer 13, and a proportional regulator (P-regulator) 24 is correspondingly in parallel with the regulator 14 in the case of failure.

An interference recognition circuit layout is indicated by reference numeral 25. This layout receives input signals from the microcomputer 13 and from the control unit sensor 19. Its output signals proceeed via lines 26 and 27 to the selected switches 20 and 21.

Interference recognition circuit layouts are known per se. They scan whether the output signal of the control unit sensor 19, for instance, is located within a permissible range and should this not be the case then they emit an error indication or a corresponding reaction signal. With respect to microcomputers as well, general safety circuits are known. For instance, they recognize whether specific command sentences or values appear in program loops and then emit a corresponding signal.

In the present case, if the microcomputer 13, which processes the driving pedal position signal as well as other signals such as those for temperature ($\nu^e$) and rpm (n) should fail, then the output signal of the driving pedal sensor is switched more or less directly to the subsequent regulator 14. The two signal converters 12 and 23 in the present exemplary embodiment exist because the sensor functions with a pulseshaped voltage and thus emits a signal of variable period. In the case of a sensor having a direct-voltage output, however, this signal could be furnished directly to the selective switch 20. Normally, regulators for fuel injection systems exhibit PID behavior (Proportional-Integral-Differential behavior). In the case of failure, it is considered to be sufficient for only a P-regulator type to be used, which then further processes the signal present at the output of the selective switch 20. It is true that in that case there is no regulation of the position of the quantity-determining member 18, but the driver has sufficiently great influence on the control of the injection quantity by way of the extent to which the driving pedal 10 is depressed.

The emergency control apparatus according to the invention, which can be switched on either automatically or manually, thus assures that in the case of the failure of one or more devices a certain amount of emergency operation can still be maintained.

What is claimed and desired to be secured by Letters Patent of the United States is:

1. In a fuel metering system of a diesel engine having a fuel pump and a fuel-quantity setting member, a series circuit including: a drive pedal position sensor, a signal processing unit connected to the drive pedal position sensor, a regulating device connected to the signal processing unit and a control unit connected to the regulating device and the fuel quanity setting member, the improvement comprising, a first emergency circuit for said signal processing unit and a second emergency circuit for said regulating device, means for recognizing a malfunction in at least one of the signal processing unit and the regulating device and means for switching either said first or said second emergency circuit into the series circuit in response to the recognition means, whereby the malfunctioning of the signal processing unit or the regulating device can be bypassed separately in said series circuit.

2. In the fuel metering system as defined in claim 1, wherein said means for switching operates automatically.

3. In the fuel metering system as defined in claim 1, wherein said means for switching operates manually.

4. In the fuel metering system as defined in claim 1, wherein said second emergency circuit includes a P-regulator located parallel to the regulating device.

5. In the fuel metering system as defined in claim 1, wherein said first emergency circuit includes a period/-voltage converter located parallel to the signal processing unit.

6. In the fuel metering system as defined in claim 1, wherein the improvement further comprises:

a control unit sensor connected to the control unit; and an interference recognition circuit connected to the control unit sensor.

7. In the fuel metering system as defined in claim 1, wherein the improvement further comprises:

a control unit sensor connected to the control unit and an interference recognition circuit connected to the control unit sensor and to the signal processing unit.

8. In the fuel metering system as defined in claim 1, wherein the improvement further comprises:

a control unit sensor connected to the control unit and an interference recognition circuit connected to the signal processing unit.

* * * * *